US012371965B1

(12) United States Patent
Foucher et al.

(10) Patent No.: US 12,371,965 B1
(45) Date of Patent: Jul. 29, 2025

(54) DOWNHOLE GRABBER SYSTEMS AND METHODS

(71) Applicant: Schlumberger Technology Corporation, Sugar Land, TX (US)

(72) Inventors: Pierre-Arnaud Foucher, Clamart (FR); Robert Kyle Wiesenborn, Sugar Land, TX (US); Zhao Jin, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/659,923

(22) Filed: May 9, 2024

(51) Int. Cl.
*E21B 31/18* (2006.01)

(52) U.S. Cl.
CPC ..... *E21B 31/18* (2013.01)

(58) Field of Classification Search
CPC ..... E21B 31/18
See application file for complete search history.

(56) References Cited

U.S. PATENT DOCUMENTS

| | | | | |
|---|---|---|---|---|
| 1,480,378 | A * | 1/1924 | Charles | E21B 31/18 294/86.23 |
| 1,529,513 | A * | 3/1925 | Swan | E21B 31/18 294/86.27 |
| 1,721,003 | A * | 7/1929 | Davison | E21B 31/18 294/86.12 |
| 4,059,155 | A | 11/1977 | Greer | |
| 9,598,922 | B1 | 3/2017 | Beynon | |
| 10,392,889 | B2 | 8/2019 | Kartha | |
| 11,274,516 | B2 | 3/2022 | Allison | |
| 2019/0301258 | A1 * | 10/2019 | Li | E21B 47/08 |
| 2024/0295158 | A1 * | 9/2024 | Mitchell | F16K 37/0033 |

FOREIGN PATENT DOCUMENTS

| | | | |
|---|---|---|---|
| EP | 3055497 | A1 | 8/2016 |
| EP | 3375973 | A1 | 9/2018 |

* cited by examiner

*Primary Examiner* — Tara Schimpf
*Assistant Examiner* — Daniel T Craig
(74) *Attorney, Agent, or Firm* — Jeffrey D. Frantz

(57) ABSTRACT

A downhole grabber system includes a lower tool assembly. The lower tool assembly includes a lower housing, a jaw assembly, and a plunger. The jaw assembly includes a first jaw pivotally coupled to the lower housing. The first jaw includes a first slot. The jaw assembly also includes a second jaw pivotally coupled to the lower housing. The second jaw includes a second slot. The plunger includes a protrusion that intersects the first and second slots throughout at least a portion of a stroke of the plunger.

20 Claims, 11 Drawing Sheets

DOWNHOLE GRABBER SYSTEMS AND METHODS

BACKGROUND

This disclosure relates to systems and methods for a downhole grabber tool used in wellbores.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

During the process of extracting hydrocarbons from drilled wells, objects and debris occasionally become lodged in the wellbore. One method of retrieving an object lodged in a wellbore involves lowering a downhole grabber tool into the wellbore. However, the use of downhole grabber tools can be a long and tedious process due to the downhole grabber tool allowing a single attempt to grab onto the lodged object while the downhole grabber is lowered within the wellbore.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a downhole grabber system includes a lower tool assembly. The lower tool assembly includes a lower housing, a jaw assembly, and a plunger. The jaw assembly includes a first jaw pivotally coupled to the lower housing. The first jaw includes a first slot. The jaw assembly also includes a second jaw pivotally coupled to the lower housing. The second jaw includes a second slot. The plunger includes a protrusion that intersects the first and second slots throughout at least a portion of a stroke of the plunger.

In another embodiment, a system includes a downhole grabber system. The downhole grabber system includes a lower tool assembly. The lower tool assembly includes a lower housing, a jaw assembly, and a plunger. The jaw assembly includes a first jaw pivotally coupled to the lower housing. The first jaw includes a first slot. The plunger includes a protrusion that intersects the first slot throughout at least a portion of a stroke of the plunger. The system also includes a controller having a memory and a processor. The controller receives a signal indicative of an axial position of the plunger. The controller also determines an estimated axial position of the plunger based on the signal.

In another embodiment, a method includes lowering a downhole grabber into a wellbore of a well. The method also includes actuating an actuator of the downhole grabber to close jaws of the downhole grabber a first time. The method also includes actuating the actuator of the downhole grabber to open the jaws of the downhole grabber. The method also includes actuating the actuator of the downhole grabber to close the jaws of the downhole grabber a second time.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
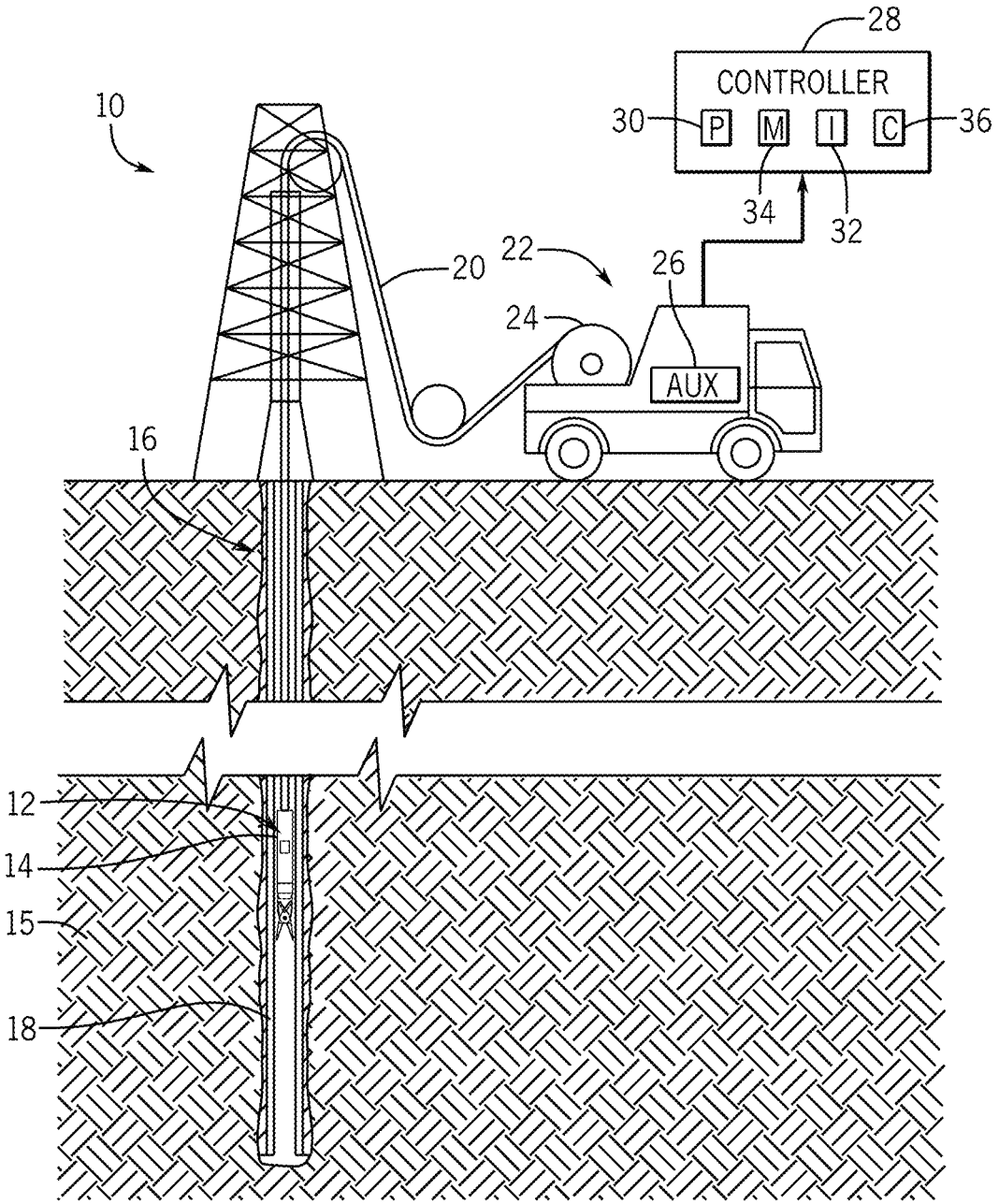
FIG. 1 is a schematic diagram of a well system having a downhole grabber system, in accordance with an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Embodiments of the present disclosure relate to systems and methods for a downhole grabber (e.g., downhole grabber tool) lowered into wellbores for retrieving lodged objects (e.g., debris, blockage, etc.). The disclosed embodiments include a downhole tool that includes a jaw assembly having one or more jaws, with at least one jaw of the one or more jaws having a slot. The downhole grabber also includes a plunger having a protrusion that intersects the slot of the one or more jaws for at least a portion of an axial translation (e.g., stroke) of the plunger. In response to an axial translation of the plunger, the jaws rotate from an open configuration to a closed configuration (e.g., or vice versa). It may be appreciated that such embodiments of opening and closing the jaws of the downhole grabber may enable the downhole grabber to make multiple (e.g., repeated) attempts of grasping an object lodged in the wellbore.

With the foregoing in mind, FIG. 1 is a schematic diagram of a well system 10 having a downhole grabber system 12. The well system 10 may be used to convey a downhole grabber 14 of the downhole grabber system 12 through a geological formation 15 via a wellbore 16. In certain embodiments, a casing 18 may be disposed within the wellbore 16, such that the downhole grabber 14 may traverse the wellbore 16 within the casing 18. As shown, the downhole grabber 14 includes jaws 21 that may grab an object (e.g., blockage, debris) disposed in the wellbore 16, as discussed in further detail herein. The downhole grabber 14 may be conveyed on a cable 20 via a cable spooling system 22. Although the cable spooling system 22 is schematically shown in FIG. 1 as a mobile cable spooling system carried by a truck, the cable spooling system 22 may instead be substantially fixed (e.g., a long-term installation that is substantially permanent or modular). Any cable 20 suitable for conveying the downhole grabber 14 may be used. The cable 20 may be spooled and unspooled on a spool 24 and an auxiliary power source 26 may provide energy to the cable spooling system 22 and/or the downhole grabber 14.

In certain embodiments, the downhole grabber system 12 may include a controller 28 via any suitable telemetry (e.g., via electrical or optical signals pulsed through the cable 20, or through the geological formation 15 or via mud pulse telemetry). The controller 28 may be any electronic data processing system that can be used to carry out the functionality described herein. For example, the controller 28 may include one or more processors 30, which may execute instructions 32 stored in memory 34 via circuitry 36. As such, the memory 34 of the controller 28 may be any suitable article of manufacture that can store the instructions 32. The memory 34 may be ROM memory, random-access memory (RAM), flash memory, an optical storage medium, or a hard disk drive, to name a few examples.

Figure 2:
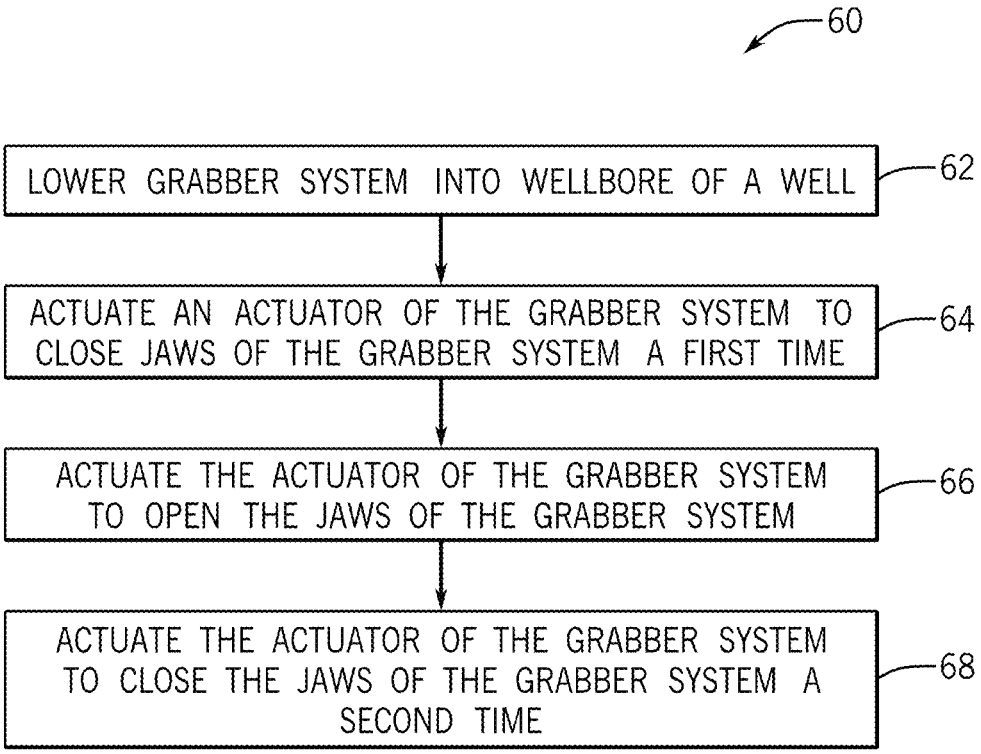
FIG. 2 is a flowchart of an example process of operating the downhole grabber system of FIG. 1, in accordance with an embodiment of the present disclosure.

FIG. 2 is a flowchart of an example process 60 of operating the downhole grabber system of FIG. 1. The process 60 may be performed by any other suitable computing device(s) or controller(s). Furthermore, the actions of the process 60 may be performed in the order disclosed herein or in any other suitable order. For example, certain actions of the process 60 may be performed concurrently. In addition, in certain embodiments, at least one of the actions of the process 60 may be omitted.

In block 62 of the process 60, the downhole grabber of the downhole grabber system is lowered into the wellbore of the well. As discussed herein, the downhole grabber may be lowered into the wellbore via one or more cables being unspooled from a spool. In certain embodiments, the downhole grabber may couple to a toolstring used for other operations, and the toolstring may be lowered into the wellbore. Additionally or alternatively, the downhole grabber may be electrically and/or hydraulically tethered to one or more components (e.g., a controller) disposed on the surface.

In block 64 of the process 60, an actuator of the downhole grabber is actuated to close the jaws of the downhole grabber a first time. In certain embodiments, prior to the actuator closing the jaws the first time, the actuator may be actuated to open the jaws. That is, as discussed herein, the jaws of the downhole grabber may be in a closed position by default. As discussed herein, the actuator may be actuated in one direction for opening the jaws, and the actuator may be actuated in a second direction for closing the jaws.

In block 66 of the process 60, the actuator is actuated to open the jaws of the downhole grabber. For example, the jaws may be reopened such that the downhole grabber may better grasp an object disposed in the wellbore. Additionally or alternatively, the jaws may be reopened in response to the object being grasped by the downhole grabber, but subsequently being dislodged.

In the block 68 of the process 60, the actuator is actuated to close the jaws of the downhole grabber a second time. For example, the jaws of the downhole grabber may be closed as part of a second attempt to grasp an object disposed in the wellbore. It may be appreciated that the jaws of the downhole grabber may be opened and/or closed repeatedly while the downhole grabber is lowered within the wellbore. Although the process 60 opens the jaws once and closes the jaws twice, it may be recognized that the jaws may be opened and/or closed any number of times while the downhole grabber is lowered within the wellbore. For example, the jaws of the downhole grabber may be opened and/or closed 2, 3, 4, 5, 6, or more times while the downhole grabber is lowered within the wellbore.

Figure 3:
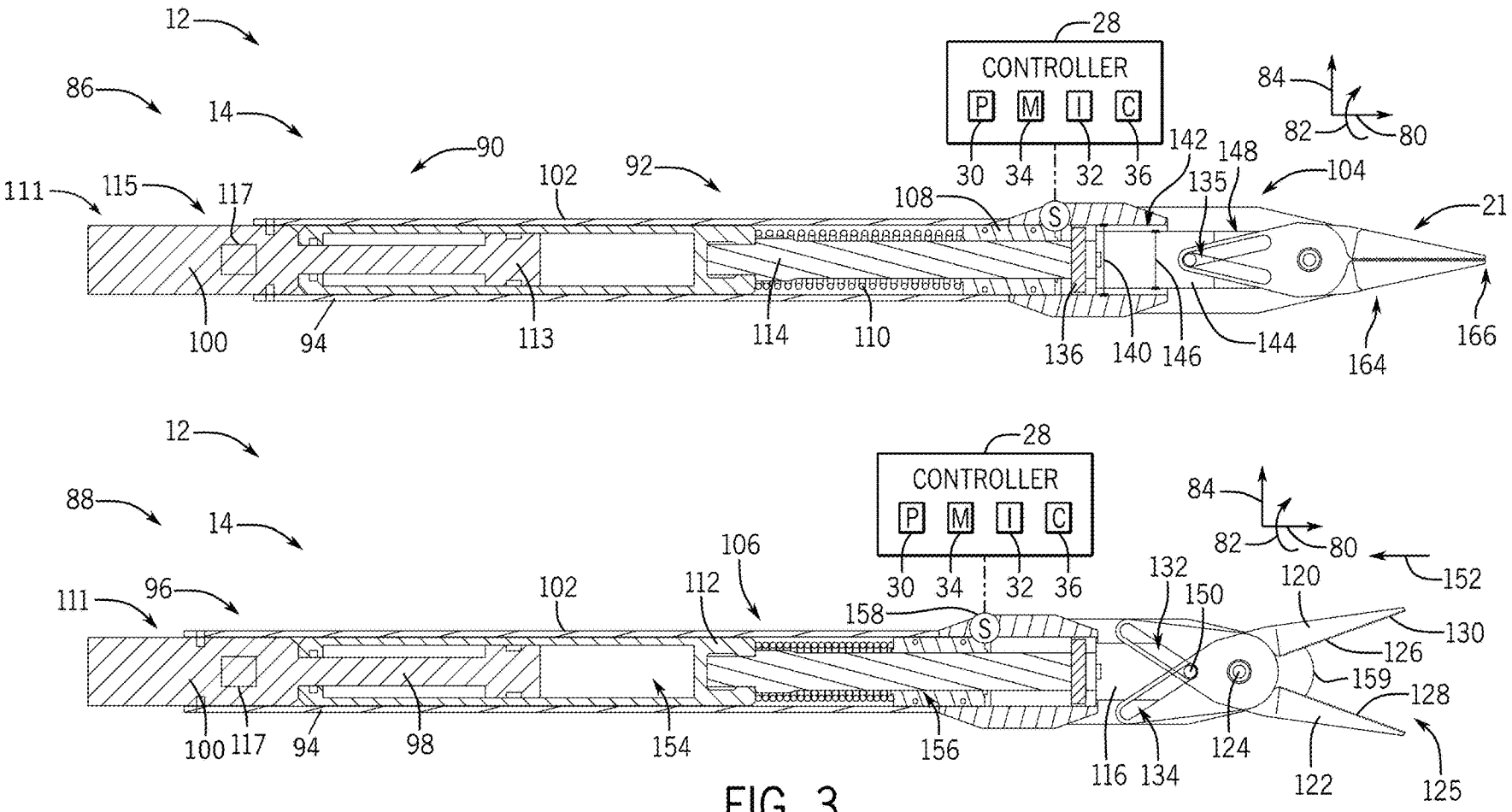
FIG. 3 is a series of side cross-sectional view of a downhole grabber of the downhole grabber system of FIG. 1, in accordance with an embodiment of the present disclosure.

FIG. 3 is a series of side cross-sectionals view of a downhole grabber 14 of the downhole grabber system 12. The downhole grabber 14 may be described relative to an axial direction 80 (e.g., downward direction), a circumferential direction 82, and a radial direction 84. In the view 86, the jaws 21 of the downhole grabber 14 are shown as being in a closed configuration. In the view 88, the jaws 21 are shown as being in an open configuration. The open and closed configuration of the jaws 21 of the downhole grabber 14 are discussed further herein.

In the illustrated embodiment, the downhole grabber 14 includes an upper tool assembly 90 and a lower tool assembly 92. As shown, the upper tool assembly 90 includes an upper housing 94 and a shaft assembly 96. The shaft assembly 96 includes a shaft 98, a bushing 100, and an actuator 111. The bushing 100 is coupled to the upper housing 94 and disposed about the shaft 98. As shown, the actuator 111 causes the shaft 98 to translate along the axial direction 80 relative to the upper housing 94 and the bushing 100. In certain embodiments, the shaft 98 may include a piston 113 (e.g., hydraulic piston) and the actuator 111 may include a hydraulic actuator 115. In certain embodiments, the actuator 111 may include an electro-mechanical actuator. As shown, the upper tool assembly 90 may also include a rotator 117 that may rotate the lower housing 102 (e.g. along with the lower tool assembly 92) relative to the upper housing 94. In certain embodiments, the rotator 117 may include a motorized swivel that rotates the lower housing 102 relative to the upper housing 94. In certain embodiments, as discussed in further detail herein, the rotator 117 may include an indexer. In certain embodiments, the rotator 117 may be omitted.

As shown, the lower tool assembly 92 includes a lower housing 102, a jaw assembly 104, a plunger assembly 106, a collar 108, and a spring 110. The plunger assembly 106 includes a collar portion 112, a rod portion 114 (e.g., shaft portion), and a plunger 116. The jaw assembly 104 includes the jaws 21 (e.g., first jaw 120, second jaw 122) pivotally coupled to the lower housing 102 via a pivot 124. The jaws 21 each include grasping surfaces 125 (e.g., grasping surfaces 126 and 128) having teeth 130. The first jaw 120 includes a first slot 132, and the second jaw 122 includes a second slot 134. As shown, the first slot 132 and the second slot 134 overlap at an intersection 135.

In the illustrated embodiment, the collar portion 112 of the plunger assembly 106 is coupled to the shaft 98 and the rod portion 114. The rod portion 114 slides through the collar 108 and couples to the plunger 116 having a flange 136. As shown, the flange 136 has a flange diameter 140 that substantially matches a diameter of a flange channel 142 of the lower housing 102. Additionally, the plunger 116 includes a body portion 144 having a body diameter 146 that substantially matches a diameter of a body channel 148 of the lower housing 102.

In the illustrated embodiment, the body portion 144 of the plunger 116 includes a protrusion 150. As shown, the protrusion 150 intersects the first slot 132 of the first jaw 120 and the second slot 134 of the second jaw 122 by protruding into the intersection 135 of the first slot 132 and the second slot 134. That is, the protrusion 150 concurrently intersects the first slot 132 and the second slot 134. In certain embodiments, the protrusion 150 may intersect the first slot 132, the second slot 134, or a combination thereof. In certain embodiments, either the first slot 132 or the second slot 134 may be omitted. In some embodiments, the plunger 116 may include one or more protrusions 150 that intersect the first slot 132, the second slot 134, or a combination thereof.

To change the jaws 21 from the closed configuration shown in the view 86 to the open configuration shown in the view 88, the shaft 98 translates in the axial direction 80 relative to the upper housing 94 and the bushing 100. The translation of the shaft 98 causes the plunger assembly 106 (e.g., the collar portion 112, the rod portion 114, and the plunger 116) to also translate in the axial direction 80. As shown, the jaws 21 rotate about the pivot 124 at least partially due to the intersection of the protrusion 150 and the first slot 132, and the intersection of the protrusion 150 and the second slot 134 during a movement (e.g., stroke) of the plunger assembly 106. That is, the jaws 21 rotate about the pivot 124 into the open configuration in response to a downward stroke of the plunger assembly 106 in the axial direction 80. Additionally or alternatively, the jaws 21 rotate about the pivot 124 into the closed configuration in response to an upward stroke of the plunger assembly 106 in an axial direction 152 that opposes the axial direction 80. During a stroke of the plunger assembly 106, the collar portion 112 may slide through a lower housing interior 154 of the lower housing 102, the rod portion 114 may slide through an opening 156 of the collar 108, the flange 136 may slide through the flange channel 142, and the body portion 144 may slide through the body channel 148.

In the illustrated embodiment, the spring 110 is coupled to the collar portion 112 of the plunger assembly 106 and the collar 108. Because the collar 108 is coupled to the lower housing 102, the spring 110 exerts a force on the plunger assembly 106 in the axial direction 152 throughout the stroke of the plunger assembly 106. In certain embodiments, the spring 110 may assist the actuator 111 to rotate the jaws 21 to the closed configuration when the shaft 98 is not extended. For example, in a scenario when the actuator 111 fails to operate (e.g., loss of power to the actuator 111), the spring 110 may press against the plunger assembly 106, thereby causing the jaws 21 to be kept in the closed configuration (e.g., fail close) by default. Additionally or alternatively, the spring 110 may help counteract the weight of the shaft 98 and/or the collar portion 112, such that they do not exert a downward force on the actuator 111.

In the illustrated embodiment, the controller 28 is communicatively coupled to a sensor 158 that provides a signal (e.g., data) indicative of an axial position of the plunger 116 relative to the lower housing 102. The controller 28 receives the signal from the sensor 158 and determines an estimated axial position of the plunger 116 relative to the lower housing 102 based on the signal. The controller 28 may determine a state of the jaws 21 (e.g., open configuration or closed configuration) based on the estimated position of the plunger 116. In certain embodiments, the controller 28 may receive one or more signals from one or more additional sensors 158. For example, in certain embodiments, the one or more sensors 158 may provide data indicative of a position (e.g., of the plunger 116), a force (e.g., applied by the actuator 111, the jaws, etc.), or a combination thereof. In certain embodiments, the controller 28 may determine an angle 159 from the grasping surface 126 to the grasping surface 128 to determine the presence of an object grasped by the jaws 21.

As shown, the first jaw 120 includes the first grasping surface 126, and the second jaw 122 includes the second grasping surface 128. As shown, the first grasping surface 126 and the second grasping surface 128 both have a flat profile with the teeth 130. In certain embodiments, the first grasping surface 126 and/or the second grasping surface 128 may have a curved profile. In some embodiments, the teeth 130 near an upper end 164 of the jaws 21 may have a different pattern (e.g., coarseness) than the teeth 130 near a lower end 166 of the jaws 21. It may be recognized that the jaws 21 of the jaw assembly 104 may include different shapes and sizes than shown in the illustrated embodiment. In certain embodiments, the lower tool assembly 92 may provide for changing the type of jaws 21 used with downhole grabber 14. For example, the lower tool assembly 92 may enable an operator to alter the downhole grabber 14 from having a first type of jaws 21 to have a second type of jaws 21.

Figure 4:
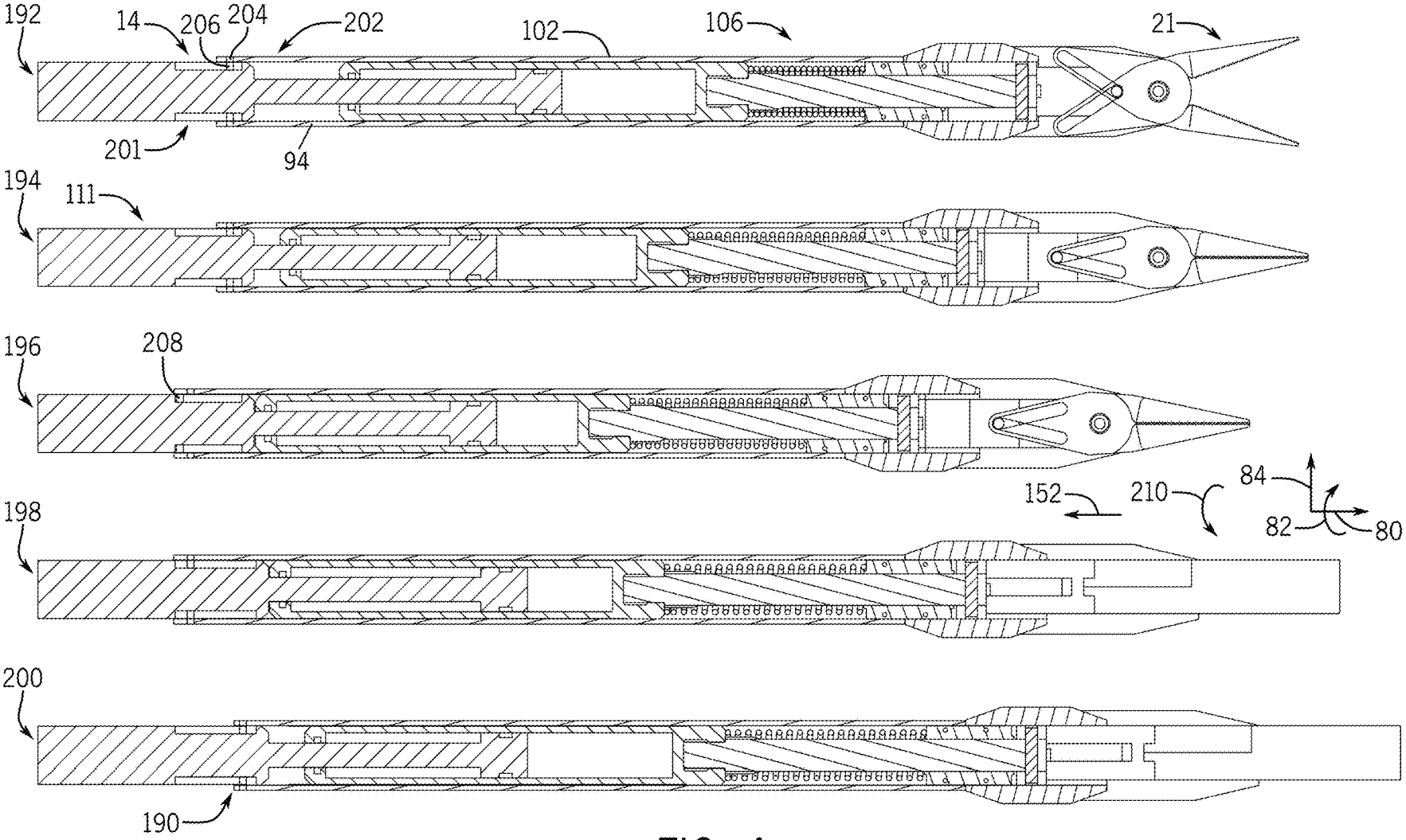
FIG. 4 is a series of side cross-sectional view of the downhole grabber of FIG. 3 having an indexer, in accordance with an embodiment of the present disclosure.

FIG. 4 is a series of side cross-sectional view of the downhole grabber 14 having a rotator 117. In the illustrated embodiment, the rotator 117 includes an indexer. In the view 192, the jaws 21 of the downhole grabber 14 are shown as being in the open configuration with the plunger assembly 106 pressed in the axial direction 80 (e.g., downward direction) by the actuator 111. In the view 194, the jaws 21 are shown as being in the closed configuration with the plunger assembly 106 retracted in the axial direction 152 (e.g., upward direction). In the view 196, the lower housing 102 has shifted, via the rotator 117, in the axial direction 152 relative to the upper housing 94. In the view 198, lower housing 102 is further translated in the axial direction 152 relative to the upper housing 94. As shown, the lower housing 102 has rotated, via the rotator 117, in the circumferential direction 82 relative to the upper housing 94. In the view 200, the lower housing 102 has translated, via the rotator 117, in the axial direction 80 relative to the upper housing 94, thereby locking the circumferential position of the lower housing 102 relative to the upper housing 94.

In the illustrated embodiment, the rotator 117 includes a lower indexer portion 202 coupled to the lower housing 102, the lower indexer portion 202 (e.g., second indexer portion) having spaced protrusions 204 (e.g., slit protrusions). Additionally, the rotator 117 includes an upper indexer portion 201 (e.g., first indexer portion) coupled to the upper housing 94, the upper indexer portion 201 having lock index protrusions 206 (e.g. lock protrusions) and an index protrusion 208. In the view 192, the spaced protrusions 204 of the lower indexer portion 202 are interlocked with the lock index protrusions 206 of the upper indexer portion 201, thereby locking the lower housing 102 circumferentially with respect to the upper housing 94. In the view 194, the lower housing 102 is translated in the axial direction 152 relative to the upper housing 94, causing the spaced protrusions 204 to contact the index protrusion 208. In the view 198, the spaced protrusions 204 are pressed against the index protrusion 208, causing the lower housing to further translate in the axial direction 152 relative to the upper housing 94. Additionally, the force exerted by the spaced protrusions 204 onto the index protrusion 208 (e.g., and vice versa) causes a concurrent rotation of the lower housing 102 relative to the upper housing 94 in the circumferential direction 82. In certain embodiments, the force exerted by the spaced protrusions onto the index protrusion 208 may cause a concurrent rotation of the lower housing relative to the upper housing 94 in a circumferential direction 210, opposite of the circumferential direction 82. Although the illustrated embodiment shows the lower housing 102 as rotating by 90 degrees relative to the upper housing 94, it may be recognized that each index interval may be less than 90 degrees, such that the sum of the index intervals is 360 degrees. For example, each index interval may be less than 90, 80, 70, 60, 50, 40, 30, 20, or 10 degrees. In the view 200, the lower housing 102 is axially translated relative to the upper housing 94 in the axial direction 80 such that the spaced protrusions 204 once again interlock with the lock index protrusions 206, thereby blocking circumferential rotation of the lower housing 102 relative to the upper housing 94. The operation of the rotator 117 is explained in further detail herein.

Figure 5:
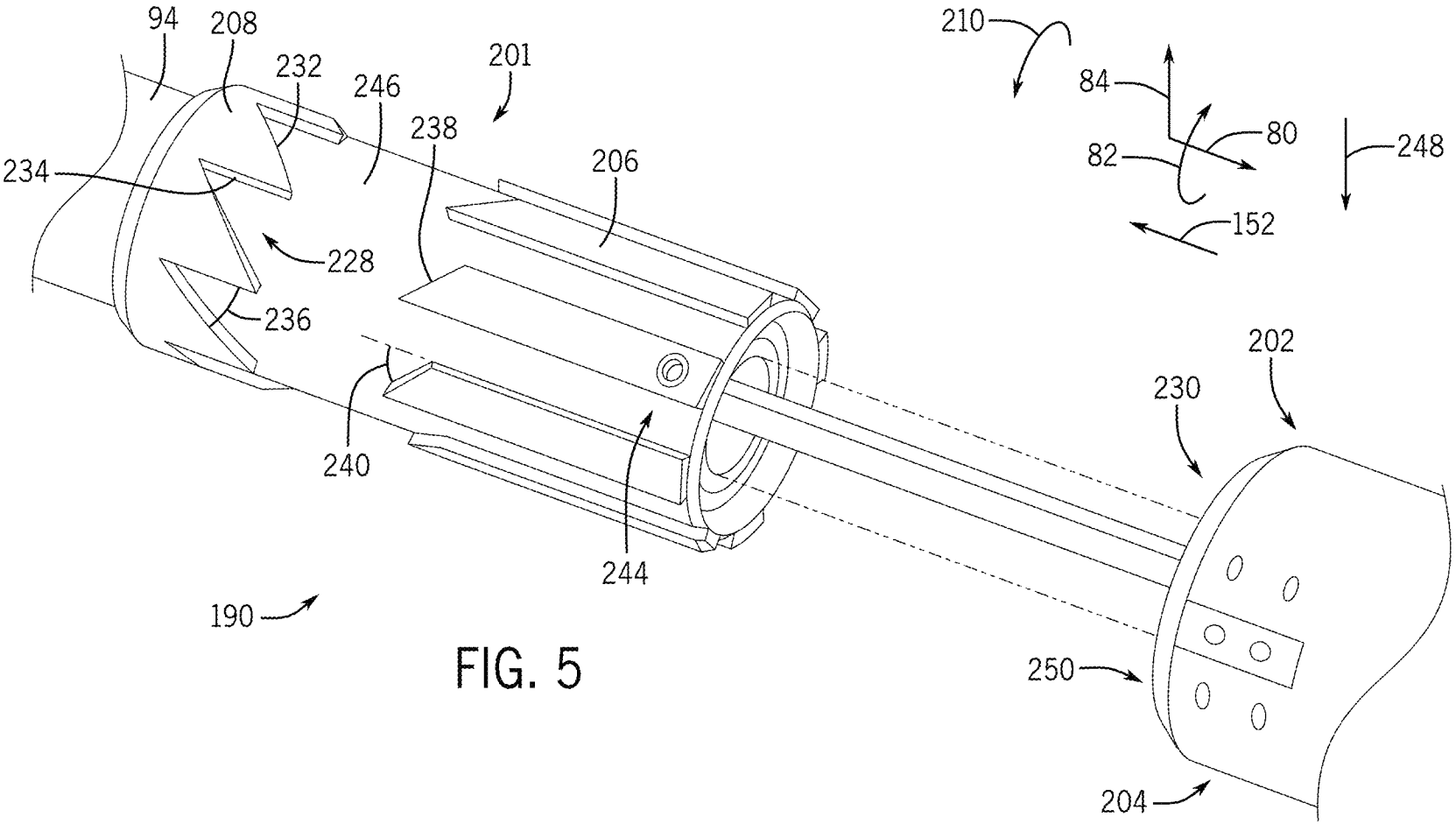
FIG. 5 is a perspective exploded view of the indexer of FIG. 4, in accordance with an embodiment of the present disclosure.

FIG. 5 is a perspective exploded view of the rotator 117. As shown, the rotator 117 includes the lower indexer portion 202 having the spaced protrusions 204. Additionally, the rotator 117 includes the upper indexer portion 201 coupled to the upper housing 94, the upper indexer portion 201 having the lock index protrusions 206 and the index protrusion 208 having index teeth 228. As shown, the lower indexer portion 202 slides over (e.g., encloses, encompasses) the upper indexer portion 201. That is, the lower indexer portion 202 includes an axial hole 230 into which the upper indexer portion 201 is inserted. In certain embodiments, the upper indexer portion 201 may slide over (e.g., enclose) the lower indexer portion 202. That is, in certain embodiments, the upper indexer portion 201 may include an axial hole 230 into which the lower indexer portion 202 is inserted.

In the illustrated embodiment, the index protrusion 208 includes diagonal surfaces 232 and axial surfaces 234. As shown, the index diagonal surfaces 232 form acute angles 236 with respect to the axial direction 80, such that the acute angles 236 are angled in the circumferential direction 82 with respect to the axial direction 152. As discussed further herein, the index diagonal surfaces 232 cause the lower indexer portion 202 to rotate in the circumferential direction 82 with respect to the axial direction 152. In the illustrated embodiment, the lock index protrusions 206 include lock diagonal surfaces 238. As shown, the lock diagonal surfaces 238 form acute angles 240 with respect to the axial direction 80, such that the acute angles 240 are angled in the circumferential direction 210, opposite the circumferential direction 82, with respect to the axial direction 152. As discussed herein, the spaced protrusions 204 slide into gaps 244 between the lock index protrusions 206 in response to being pressed against the lock index protrusions 206. As shown, the index protrusion 208 is disposed upward (e.g., in the axial direction 152) relative to the lock index protrusions 206.

In certain embodiments, the index diagonal surfaces 232 may form the acute angles 236 with respect to the axial direction 80, such that the acute angles 236 may be angled in the circumferential direction 210, opposite the circumferential direction 82, with respect to the axial direction 152. In certain embodiments, the lock diagonal surfaces 238 may form the acute angles 240 with respect to the axial direction 80, such that the acute angles 240 may be angled in the circumferential direction 82, with respect to the axial direction 152. In certain embodiments, the lock index protrusions 206 may be disposed upward (e.g., in the axial direction 152) relative to the index protrusion 208.

In the illustrated embodiment, the lock index protrusions 206 and the index protrusion 208 are shown as protruding radially outward (e.g., in the radial direction 84) from an outer surface 246 of the upper indexer portion 201. As shown, the upper indexer portion 201 is coupled to the upper housing 94. Additionally, in the illustrated embodiment, the spaced protrusions 204 protrude radially inward in a radial direction 248, opposite the radial direction 84, from an inner surface 250 of the lower indexer portion 202. The lower indexer portion 202 is coupled to the lower housing.

In certain embodiments, the lock index protrusions 206 and the index protrusion 208 may protrude radially inward in the radial direction 248 from the inner surface 250 of the lower indexer portion 202. In certain embodiments, the lower indexer portion 202 may be coupled to the upper housing 94. Additionally, in certain embodiments, the spaced protrusions 204 may protrude radially outward in the radial direction 84 from the outer surface 246 of the upper indexer portion 201. In certain embodiments, the upper indexer portion 201 may be coupled to the lower housing.

Figure 6:
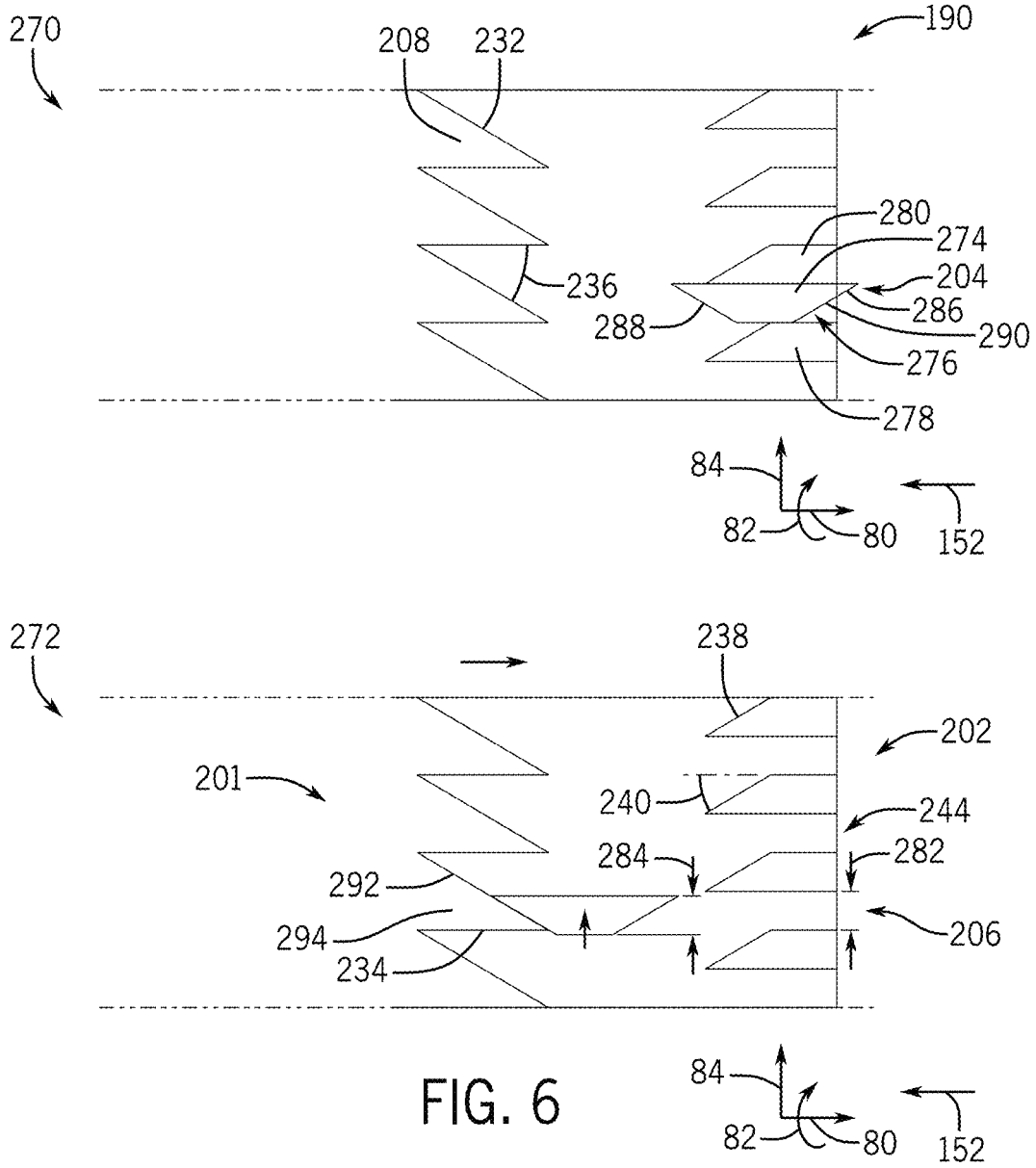
FIG. 6 is a schematic view of first and second instances of an indexing sequence of the indexer of FIG. 4, in accordance with an embodiment of the present disclosure.

FIG. 6 is a schematic view of first and second instances 270 and 272 of an indexing sequence of the rotator 117. In the first instance 270, a spaced protrusion 274 of the space protrusions 204 is at least partially secured (e.g., restrained) in a gap 276 (e.g. of the gaps 244) between the lock index protrusions 278 and 280 of the lock index protrusions 206. As shown, a circumferential gap width 282 of the gap 276 substantially matches a circumferential protrusion width 284 of the spaced protrusion 274. The spaced protrusion 274 includes spaced diagonal surfaces 286 (e.g., spaced diagonal surfaces 288 and 290). It may be recognized that the spaced protrusions 204 may include one or more spaced protrusions 204.

In the illustrated embodiment, the index protrusion 208 includes diagonal surfaces 232 and axial surfaces 234. As shown, the index diagonal surfaces 232 form acute angles 236 with respect to the axial direction 80, such that the acute angles 236 are angled in the circumferential direction 82 with respect to the axial direction 152. As discussed further herein, the index diagonal surfaces 232 cause the lower indexer portion 202 to rotate in the circumferential direction 82 with respect to the axial direction 152. In the illustrated embodiment, the lock index protrusions 206 include lock diagonal surfaces 238. As shown, the lock diagonal surfaces 238 form acute angles 240 with respect to the axial direction 80, such that the acute angles 240 are angled in the circumferential direction 210, opposite the circumferential direction 82, with respect to the axial direction 152. As discussed herein, the lock diagonal surfaces 238 may guide the spaced protrusion 274 into the gaps 244 in response to the spaced protrusion being pressed against the lock diagonal surfaces 238.

As shown, in the second instance 272, the upper indexer portion 201 has shifted in the axial direction 80 (e.g., downward direction) relative to the lower indexer portion 202. That is, the upper housing has shifted in the axial direction relative to the lower housing. In the illustrated embodiment, the spaced diagonal surface 288 of the spaced protrusion 274 is contacting (e.g., exerting a force on) an index diagonal surface 292 of an index tooth 294 of the index teeth 228 of the index protrusion 208. In response to the spaced protrusion 274 contacting the index diagonal surface 292, the spaced protrusion 274 begins to rotate in the circumferential direction 82. That is, in response to the spaced protrusion 274 contacting the index diagonal surface 292, the lower index portion 202 begins to rotate in the circumferential direction 82 relative to the upper index portion 201.

Figure 7:
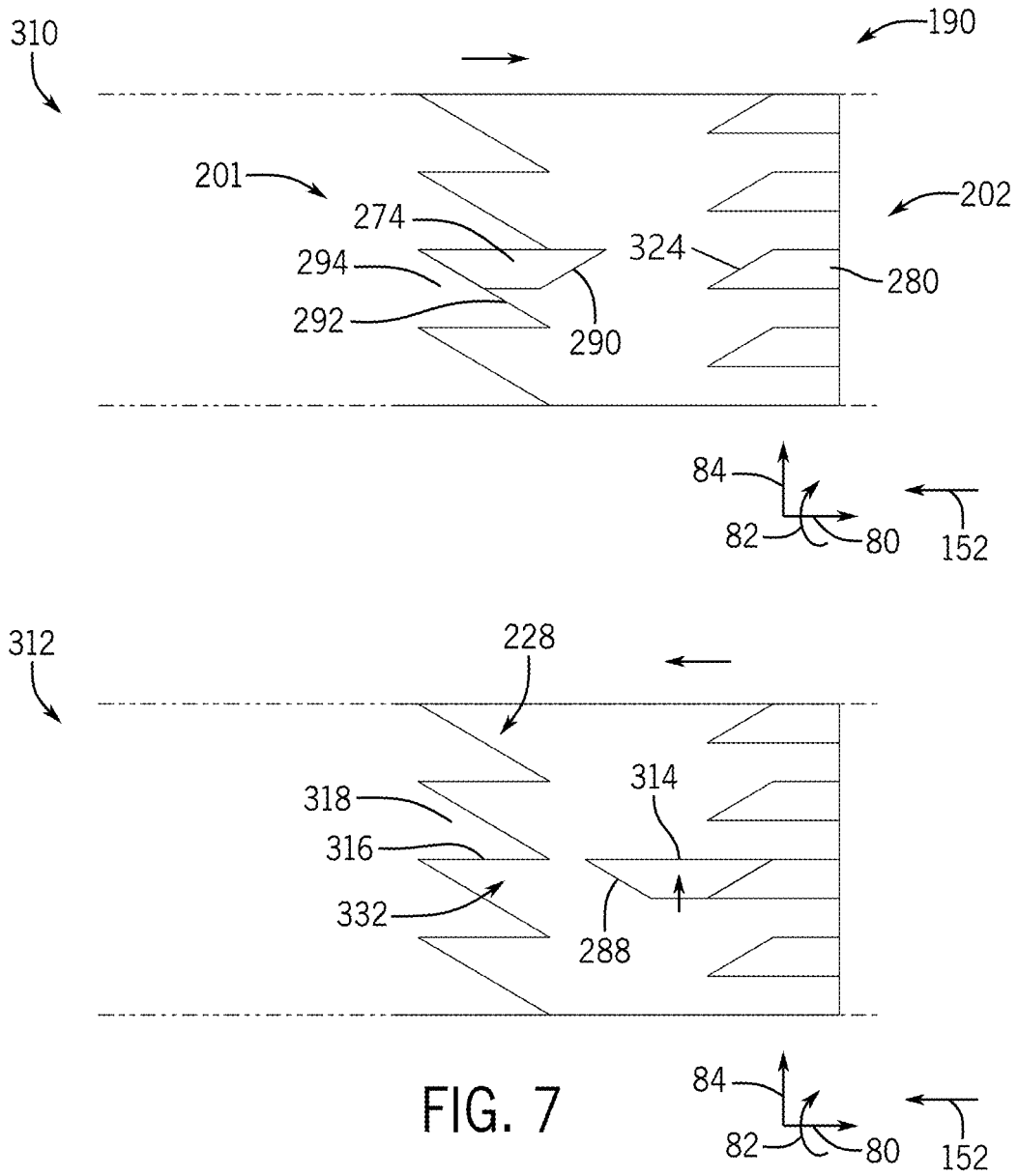
FIG. 7 is a schematic view of third and fourth instances of the indexing sequence of the indexer of FIG. 4, in accordance with an embodiment of the present disclosure.

FIG. 7 is a schematic view of third and fourth instances 310 and 312 of the indexing sequence of the rotator 117. As shown, the upper indexer portion 201 has continued to shift in the axial direction 80 (e.g., downward direction) relative to the lower indexer portion 202 until the spaced diagonal surface 288 of the spaced protrusion 274 is contacting the index diagonal surface 292 of the index tooth 294, while a spaced axial surface 314 of the spaced protrusion 274 concurrently contacts an index axial surface 316 of an index tooth 318 of the index teeth 228.

Due to the index diagonal surface 292 exerting a force onto the spaced diagonal surface 288 (e.g., and vice versa) having a component in the circumferential direction 82, the spaced protrusion 274 has rotated in the circumferential direction 82. That is, in response to the index diagonal surface 292 exerting a force onto the spaced diagonal surface 288, the lower index portion has rotated in the circumferential direction 82 relative to the upper index portion. As shown in the third instance 310, the spaced protrusion 274 is lodged into a bottom portion of a crevice 332 disposed between the index tooth 294 and the index tooth 318.

In the fourth instance 312, the upper indexer portion 201 has moved in the axial direction 152 (e.g., upward direction) relative to the lower indexer portion 202 until the spaced diagonal surface 290 contacts a lock diagonal surface 324 of the lock index protrusion 280. The lock diagonal surface 324 exerts a force on the spaced protrusion 274 (e.g., and vice versa). The force has a component in the circumferential direction 82, causing the spaced protrusion 274 to rotate in the circumferential direction 82, thereby causing the lower indexer portion 202 to circumferentially rotate in the circumferential direction 82 relative to the upper indexer portion 201.

Figure 8:
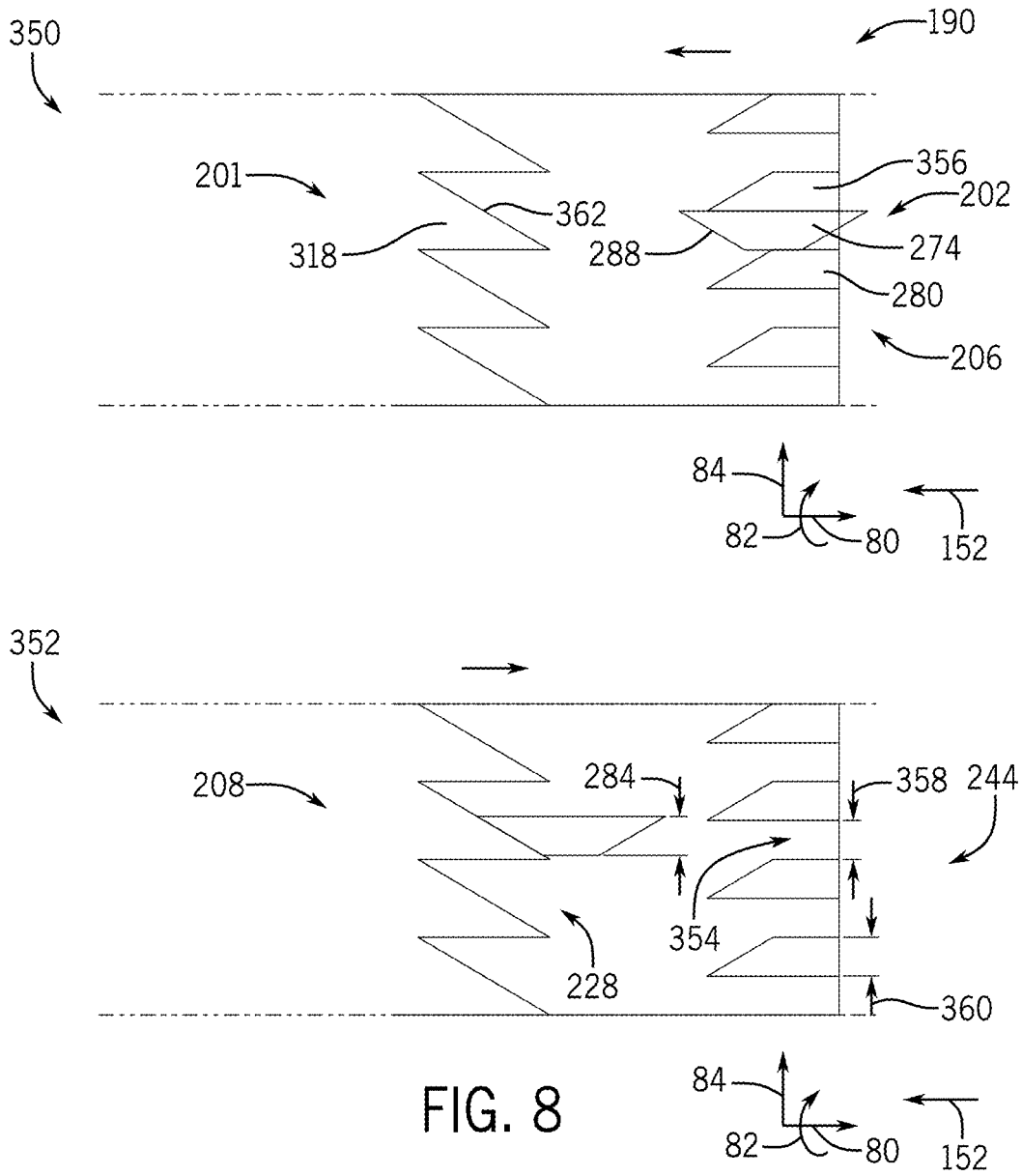
FIG. 8 is a schematic view of fifth and sixth instances of the indexing sequence of the indexer of FIG. 4, in accordance with an embodiment of the present disclosure.

FIG. 8 is a schematic view of fifth and sixth instances 350 and 352 of an indexing sequence of the rotator 117. In the fifth instance 350, the spaced protrusion 274 is at least partially secured (e.g., restrained) in a gap 354 (e.g. of the gaps 244) between the lock index protrusions 280 and 356 of the lock index protrusions 206. As shown, a circumferential gap width 358 of the gap 354 substantially matches the circumferential protrusion width 284 of the spaced protrusion 274. In certain embodiments, the gaps 244 may have substantially matching circumferential gap widths 360. As shown, the upper index portion 201 has shifted in the axial direction 152 (e.g., upward direction), thereby causing the spaced protrusion 274 to circumferentially shift into the gap 354.

As shown, in the sixth instance 352, the upper indexer portion 201 has shifted in the axial direction 80 (e.g., downward direction) relative to the lower indexer portion 202. That is, the upper housing has shifted in the axial direction relative to the lower housing. In the illustrated embodiment, the spaced diagonal surface 288 of the spaced protrusion 274 is contacting (e.g., exerting a force on) an index diagonal surface 362 of the index tooth 318 of the index teeth 228 of the index protrusion 208. In response to the spaced protrusion 274 contacting the index diagonal surface 362, the spaced protrusion 274 begins to rotate in the circumferential direction 82. That is, in response to the spaced protrusion 274 contacting the index diagonal surface 362, the lower index portion 202 begins to rotate in the circumferential direction 82 relative to the upper index portion 201.

Figure 9:
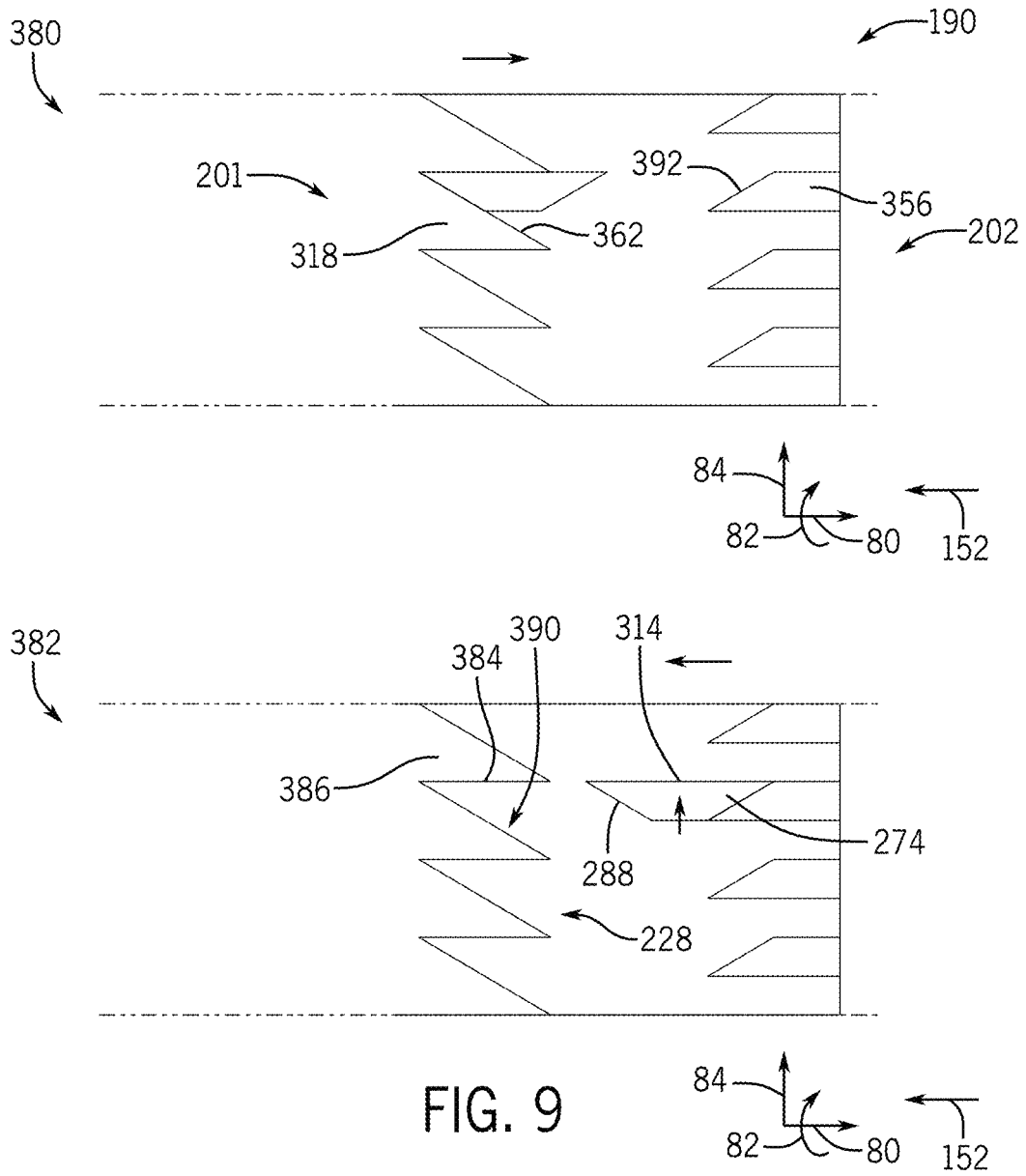
FIG. 9 is a schematic view of a seventh instance of the indexing sequence of the indexer of FIG. 4, in accordance with an embodiment of the present disclosure.

FIG. 9 is a schematic view of seventh and eighth instances 380 and 382 of the indexing sequence of the rotator 117. As shown, the upper indexer portion 201 has continued to shift in the axial direction 80 (e.g., downward direction) relative to the lower indexer portion 202 until the spaced diagonal surface 288 of the spaced protrusion 274 is contacting the index diagonal surface 362 of the index tooth 318, while the spaced axial surface 314 of the spaced protrusion 274 concurrently contacts an index axial surface 384 of an index tooth 386 of the index teeth 228.

Due to the index diagonal surface 362 exerting a force onto the spaced diagonal surface 288 (e.g., and vice versa) having a component in the circumferential direction 82, the spaced protrusion 274 has rotated in the circumferential direction 82. That is, in response to the index diagonal surface 292 exerting a force onto the spaced diagonal surface 288, the lower index portion has rotated in the circumferential direction 82 relative to the upper index portion. As shown in the seventh instance 380, the spaced protrusion 274 is lodged into a bottom portion of a crevice 390 disposed between the index tooth 318 and the index tooth 386.

In the eighth instance 382, the upper indexer portion 201 has moved in the axial direction 152 (e.g., upward direction) relative to the lower indexer portion 202 until the spaced diagonal surface 290 contacts a lock diagonal surface 392 of the lock index protrusion 356. The lock diagonal surface 392 exerts a force on the spaced protrusion 274 (e.g., and vice versa). The force has a component in the circumferential direction 82, causing the spaced protrusion 274 to rotate in the circumferential direction 82, thereby causing the lower indexer portion 202 to circumferentially rotate in the circumferential direction 82 relative to the upper indexer portion 201.

It may be recognized that while the illustrated indexing sequence illustrates the upper indexer portion 201 moving relative to the lower indexer portion 202, in certain embodiments the lower indexer portion may move (e.g., shift) relative to the upper indexer portion 201. That is, in certain embodiments, the upper housing may move relative to the lower housing. In some embodiments, the upper indexer portion 201 may shift in the axial direction 80 while the lower indexer portion 202 may shift in the axial direction 152. That is, in some embodiments, both the upper housing and the lower housing may concurrently move in opposite directions.

Figure 10:
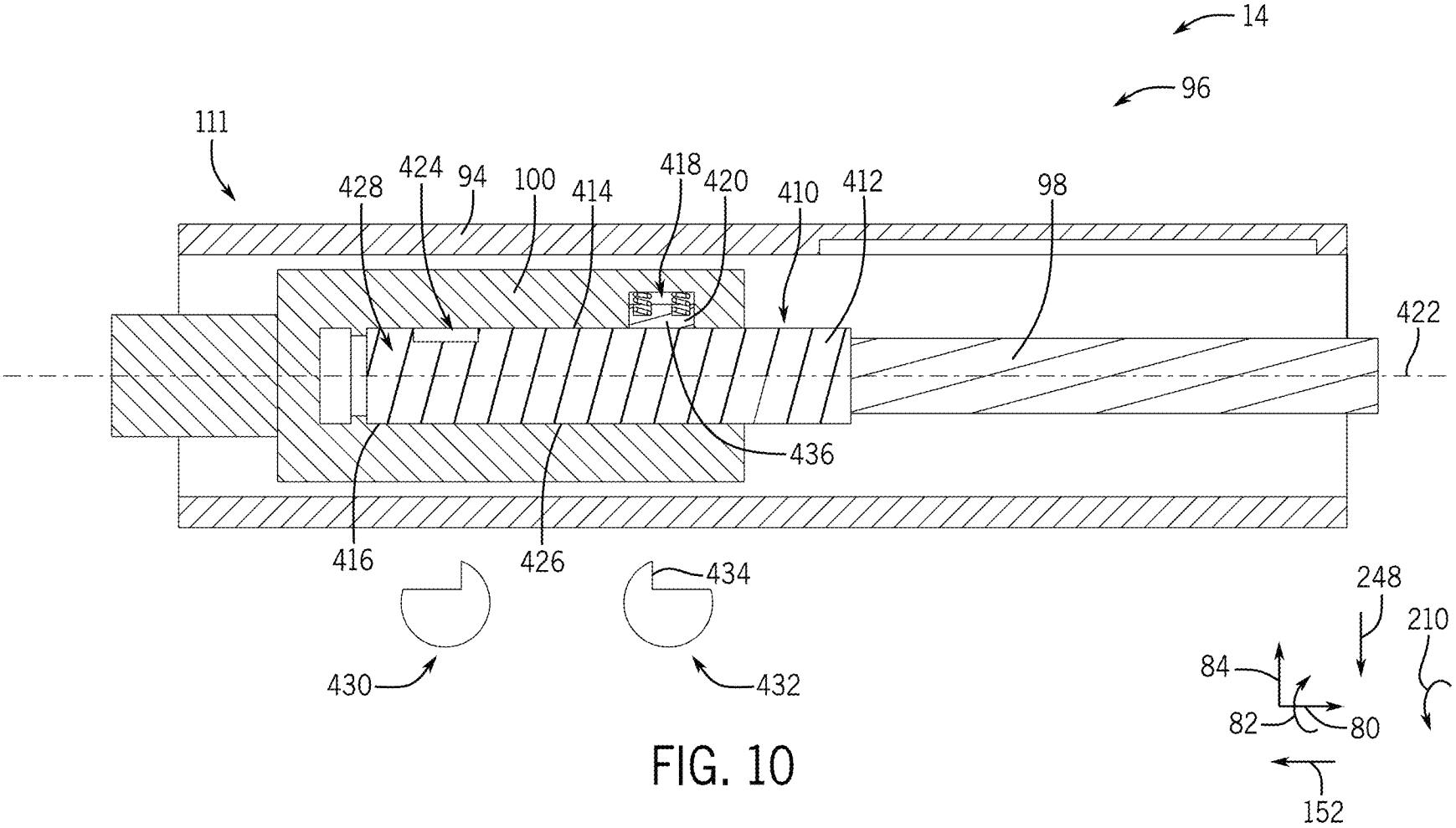
FIG. 10 is a schematic view of a shaft assembly of the downhole grabber of FIG. 3, in accordance with an embodiment of the present disclosure.

FIG. 10 is a schematic view of the shaft assembly 96 of the downhole grabber 14. In the illustrated embodiment, the shaft assembly 96 includes the shaft 98, the bushing 100, and the actuator 111. The bushing 100 is coupled to the upper housing 94 and disposed about the shaft 98. As shown, the shaft 98 includes a threaded portion 410 having exterior threads 412 that interlock with interior threads 414 formed into an inner surface 416 of the bushing 100. Additionally, as shown, the bushing 100 includes a recess 418 formed into the inner surface 416. The shaft assembly 96 includes a spring-loaded pin 420 disposed in the recess 418. The spring-loaded pin 420 presses against the shaft 98 in the radial direction 248.

The actuator 111 turns the shaft 98 circumferentially about the central axis 422, thereby causing the shaft 98 to concurrently axially extend from the bushing 100 in the axial direction 80 (e.g., downward direction) due to the interlocking of the exterior threads 412 of the shaft 98 and the interior threads 414 of the bushing 100. Additionally, the actuator 111 may turn the shaft 98 circumferentially about the central axis 422 in the opposite circumferential direction, thereby causing the shaft 98 to concurrently axially retract into the bushing 100 in the axial direction 152. In the illustrated embodiment, the actuator 111 rotates the shaft 98 in the circumferential direction 82 in order to axially extend the shaft 98. In certain embodiments, the actuator 111 may rotate the shaft 98 in the circumferential direction 210 in order to axially extend the shaft 98.

In the illustrated embodiment, the shaft 98 includes a receiving recess 424 formed into an outer surface 426 of the threaded portion 410 of the shaft 98. In the illustrated embodiment, the receiving recess 424 is disposed near a distal end 428 of the shaft 98. In response to an axial alignment between the recess 418 and the receiving recess 424, the spring-loaded pin 420 protrudes from the recess 418 into the receiving recess 424, thereby blocking further axial extension of the shaft 98. The cross sections 430 and 432 show possible cross sections of the receiving recess 424. As shown, the receiving recess 424 includes one side wall 434 that contacts (e.g., catches) a side wall 436 of the spring-loaded pin 420 in response to an attempted further rotation of the shaft 98, thereby blocking further rotation of the shaft 98 in response to the spring-loaded pin 420 protruding into the recess 418.

Figure 11:
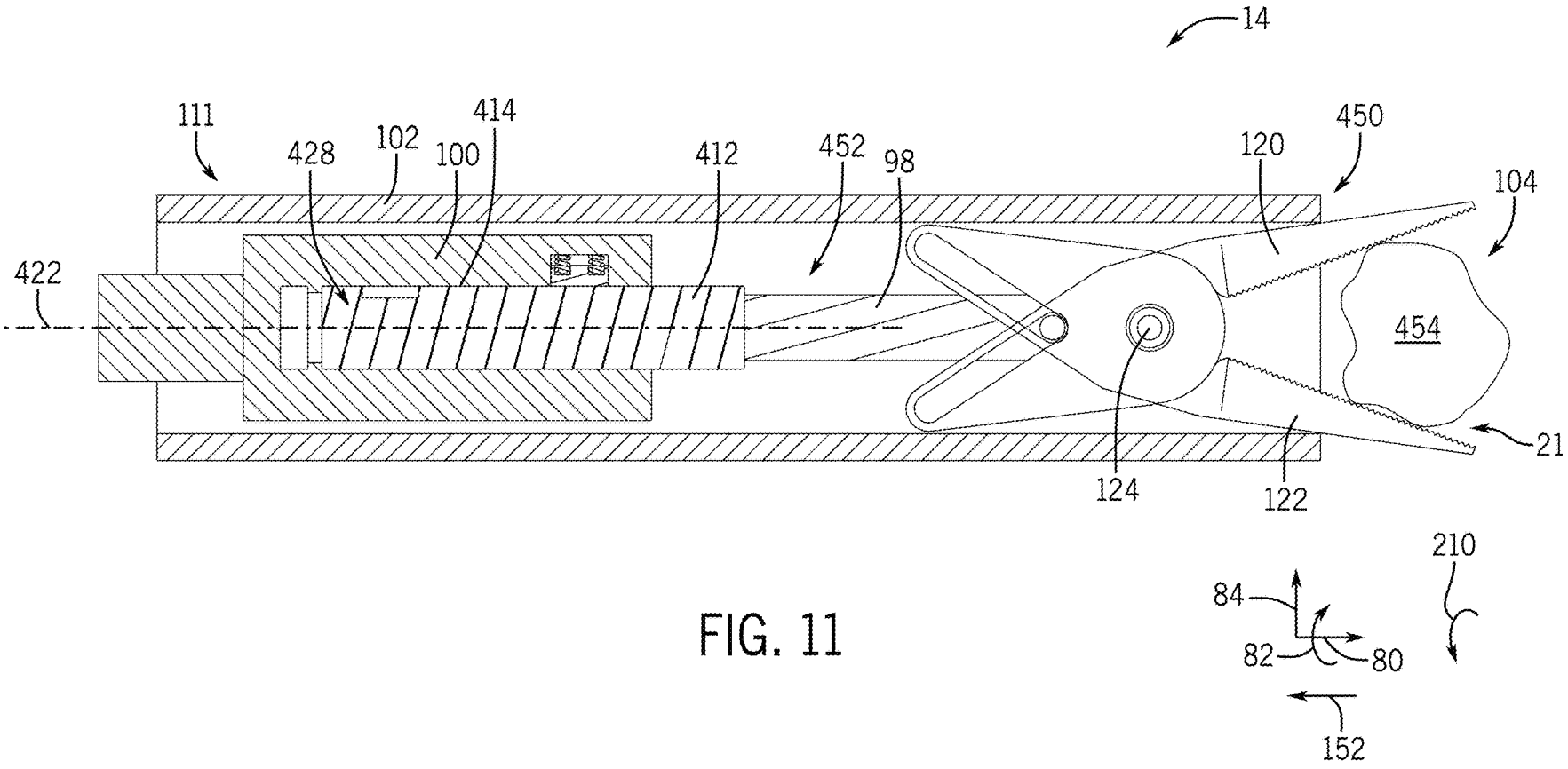
FIG. 11 is a schematic view of the downhole grabber of FIG. 3, in accordance with an embodiment of the present disclosure.

FIG. 11 is a schematic view of the downhole grabber 14. As discussed herein, the actuator 111 turns the shaft 98 circumferentially about the central axis 422, thereby causing the shaft 98 to concurrently axially extend from the bushing 100 in the axial direction 80 (e.g., downward direction) due to the interlocking of the exterior threads 412 of the shaft 98 and the interior threads 414 of the bushing 100. Additionally, the actuator 111 may turn the shaft 98 circumferentially about the central axis 422 in the opposite circumferential direction, thereby causing the shaft 98 to concurrently axially retract into the bushing 100 in the axial direction 152. In the illustrated embodiment, the actuator 111 rotates the shaft 98 in the circumferential direction 82 in order to axially extend the shaft 98. In certain embodiments, the actuator 111 may rotate the shaft 98 in the circumferential direction 210 in order to axially extend the shaft 98.

In the illustrated embodiment, the jaw assembly 104 is coupled to the shaft 98. As shown, the first jaw 120 and the second jaw 122 are each pivotally coupled to the shaft 98 via the pivot 124. As shown, first jaw 120 and the second jaw 122 extend past the lower housing 102 (e.g., sleeve) when the jaws 21 extend past a distal end 450 of the lower housing 102. As shown, the shaft 98 may axially translate the jaws 21 to at least partially retract into an interior area 452 of the lower housing 102. In the illustrated embodiment, the first jaw 120 and the second jaw 122 contact the lower housing 102 as the jaws 21 are retracted (e.g., pulled) into the interior area 452 of the lower housing 102. The lower housing 102 compresses the jaws 21, thereby causing the jaws 21 to grasp an object 454 lodged in the wellbore.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical.

The invention claimed is:

1. A downhole grabber, comprising:

a lower tool assembly comprising:

a lower housing;

a jaw assembly comprising:

a first jaw pivotally coupled to the lower housing, the first jaw comprising a first slot; and a second jaw pivotally coupled to the lower housing, the second jaw comprising a second slot;

a plunger comprising a protrusion configured to intersect the first and second slots throughout at least a portion of a stroke of the plunger; and a spring coupled to the plunger, wherein the spring is configured to exert an upward force on the plunger to enable the first and second jaws to fail close by default.

2. The downhole grabber of claim 1, comprising an upper tool assembly comprising:

an upper housing; and a shaft configured to axially translate relative to the upper housing, wherein the shaft is coupled to the plunger.

3. The downhole grabber of claim 1, wherein the first and second jaws are configured to:

rotate into an open configuration in response to a downward stroke of the plunger; and rotate into a closed configuration in response to an upward stroke of the plunger.

4. The downhole grabber of claim 2, wherein the lower housing is configured to rotate circumferentially with respect to the upper housing.

5. The downhole grabber of claim 4, comprising an indexer configured to enable the circumferential rotation.

6. The downhole grabber of claim 5, wherein the indexer comprises a first indexer portion, the first indexer portion comprising:

an indexing protrusion; and a plurality of lock protrusions.

7. The downhole grabber of claim 6, wherein the indexer comprises a second indexer portion, the second indexer portion comprising a plurality of slit protrusions configured to interlock with the plurality of lock protrusions.

8. The downhole grabber of claim 7, wherein the second indexer portion is configured to concurrently axially translate and circumferentially rotate relative to the first indexer portion in response to the plurality of slit protrusions being pressed against the indexing protrusion.

9. The downhole grabber of claim 2, wherein the upper tool assembly comprises a bushing coupled to the upper housing, the bushing comprising having interior threads, wherein the shaft comprises a threaded end portion comprising corresponding exterior threads configured to interlock with the interior threads.

10. The downhole grabber of claim 9, wherein an interlocking of the interior threads and the corresponding exterior threads is configured to:

cause a circumferential rotation of the shaft relative to the bushing; and concurrently cause an axial translation of the shaft relative to the bushing.

11. The downhole grabber of claim 10, wherein the bushing comprises a recess formed into an inner surface of the bushing, wherein the upper tool assembly comprises a spring-loaded pin disposed in the recess, the spring-loaded pin configured to radially press against the shaft.

12. The downhole grabber of claim 11, wherein the shaft comprises a receiving recess formed into an outer surface of the shaft, wherein the spring-loaded pin is configured to protrude into the receiving recess in response to an axial alignment between the recess and the spring-loaded pin.

13. The downhole grabber of claim 2, wherein the first and second jaws are pivotally coupled to the shaft, wherein the lower housing is configured to compress the first and second jaws in response to the first and second jaws retracting into the lower housing.

14. A system, comprising:

a downhole grabber, comprising:

a lower tool assembly comprising:

a lower housing;

a jaw assembly comprising:

a first jaw pivotally coupled to the lower housing, the first jaw comprising a first slot; and a second jaw pivotally coupled to the lower housing, the second jaw comprising a second slot;

a plunger comprising a protrusion configured to intersect the first and second slots throughout at least a portion of a stroke of the plunger; and a spring coupled to the plunger, wherein the spring is configured to exert an upward force on the plunger to enable the first and second jaws to fail close by default; and a controller having a memory and a processor, the controller configured to:

receive a signal indicative of an axial position of the plunger; and determine an estimated axial position of the plunger based on the signal.

15. The system of claim 14, wherein the protrusion is configured to concurrently intersect the first and second slots throughout the at least a portion of the stroke of the plunger.

16. The system of claim 15, comprising an actuator configured to axially translate the plunger, wherein the actuator comprises:

a hydraulic actuator;

an electromechanical actuator;

or a combination thereof.

17. The system of claim 15, wherein the controller is configured to determine an angle between the first jaw and the second jaw based on the estimated axial position.

18. A method, comprising:

lowering a downhole grabber into a wellbore of a well, wherein the downhole grabber comprises:

a lower tool assembly comprising:

a lower housing;

a jaw assembly comprising:

a first jaw pivotally coupled to the lower housing, the first jaw comprising a first slot; and a second jaw pivotally coupled to the lower housing, the second jaw comprising a second slot;

a plunger comprising a protrusion configured to intersect the first and second slots throughout at least a portion of a stroke of the plunger; and a spring coupled to the plunger, wherein the spring is configured to exert an upward force on the plunger to enable the first and second jaws to fail close by default;

actuating an actuator of the downhole grabber to close the first and second jaws of the downhole grabber a first time;

actuating the actuator of the downhole grabber to open the first and second jaws of the downhole grabber; and actuating the actuator of the downhole grabber to close the first and second jaws of the downhole grabber a second time.

19. The method of claim 18, wherein the downhole grabber further comprises an upper tool assembly comprising:

an upper housing; and a shaft configured to axially translate relative to the upper housing, wherein the shaft is coupled to the plunger.

20. The method of claim 18, wherein the actuator comprises:

a hydraulic actuator;

an electromechanical actuator;

or a combination thereof.

* * * * *